US006036123A

United States Patent [19]

West

[11] Patent Number: 6,036,123

[45] Date of Patent: Mar. 14, 2000

[54] APPARATUS FOR APPLYING FOAM MATERIAL TO A SUBSTRATE

[76] Inventor: Richard A. West, 31303 Nantucket Row, Bay Village, Ohio 44140

[21] Appl. No.: 09/240,149

[22] Filed: Jan. 29, 1999

[51] Int. Cl.[7] ..... B05B 3/00; B05B 3/18

[52] U.S. Cl. ..... 239/750; 239/227; 239/587.5; 239/752; 239/753; 118/305; 118/323

[58] Field of Search ..... 239/227, 587.5, 239/750, 752, 753, 754; 118/305, 323; 427/186

[56] References Cited

U.S. PATENT DOCUMENTS

| | | | |
|---|---|---|---|
| 2,367,594 | 1/1945 | Madison | 118/305 X |
| 3,924,565 | 12/1975 | Benner et al. | 118/323 |
| 4,087,296 | 5/1978 | Hooker . | |
| 4,209,557 | 6/1980 | Edwards . | |
| 4,333,973 | 6/1982 | Bellafiore et al. . | |
| 4,842,200 | 6/1989 | Hermansson | 239/752 X |
| 4,872,417 | 10/1989 | Kuwabara et al. | 239/587.5 X |
| 4,911,188 | 3/1990 | Seidel | 239/750 X |
| 5,348,585 | 9/1994 | Weston | 118/305 |
| 5,361,993 | 11/1994 | Andersson | 239/752 |
| 5,670,178 | 9/1997 | West . | |

*Primary Examiner*—Lesley D. Morris
*Assistant Examiner*—Robin O. Evans
*Attorney, Agent, or Firm*—Vickers, Daniels & Young

[57] ABSTRACT

Apparatus for applying foamed plastic material on a roof deck comprises a wheeled frame moveable along the deck and carrying a foamed plastic dispenser support and drive assembly which extends transverse to the direction of movement of the frame and which includes a carriage reciprocable in opposite directions along a linear carriage path and supporting a foamed plastic dispenser for reciprocation therewith and for pivotal displacement relative thereto at each of the opposite ends of the carriage path about a horizontal axis transverse to the carriage path so as to pivot the dispenser for discharging the foamed plastic material laterally outwardly of the ends of the support and drive assembly.

37 Claims, 5 Drawing Sheets

APPARATUS FOR APPLYING FOAM MATERIAL TO A SUBSTRATE

BACKGROUND OF THE INVENTION

The present invention relates to the art of applying plastic foams to a substrate and, more particularly, to apparatus providing improved control of the vertical profile of the applied plastic foam.

The invention finds particular utility in connection with the application of plastic foams to a roof deck and, accordingly, will be disclosed and described in detail herein in connection with such use. At the same time, however, it will be appreciated that the invention is applicable to the applying of plastic substrates other than roofing decks.

The spray application of plastic foams, such as polyurethane foams, to an underlying substrate is well known as shown, for example, in U.S. Pat. No. 4,209,557 to Edwards and U.S. Pat. No. 4,333,973 to Bellafiore, et al. In the Edwards and Bellafiore, et al. patents, a dispenser in the form of a spray nozzle is supported above a substrate for spraying an expandable plastic foam material downwardly thereunto. The nozzle and substrate are relatively displaceable in a given direction, and the nozzle is displaceable relative to the substrate along the path transverse to the given direction. More particularly, in Edwards the spray nozzle is slidably mounted on a fixed support extending transverse to the direction of movement of a sheet material substrate therebeneath, and the nozzle is reciprocated in opposite directions along the support to spray foam material on the sheet moving therebeneath. In Bellafiore, et al., the nozzle is mounted on a wheeled frame which is displaceable along an underlying substrate such as a roof deck, and the nozzle is mounted on the frame for movement therewith and for reciprocating displacement relative thereto along a path transverse to the direction of movement of the frame, whereby the foam material is sprayed downwardly onto the roof deck as the frame moves therealong. In both Edwards and Bellafiore, et al., and as is well known in connection with the spray application of plastic foams, the foam comprises liquid chemicals which are preheated and pumped through lengths of heated hose and are mixed in a mixer or spray gun and sprayed onto the underlying substrate where they cure in a matter of seconds.

In connection with the spraying of plastic foam material onto a roof deck as shown in Bellafiore, et al., and as recognized in Edwards, the reciprocation of the spray nozzle in opposite directions requires the latter to decelerate, stop and reaccelerate in the opposite direction at each end of the path of movement thereof, whereby there is a vertical buildup of the plastic foam along the opposite edges of a layer of plastic foam applied to the underlying substrate. In Edwards, this problem is addressed by mounting the nozzle for the vertical plane of the spray to be at an angle with respect to the direction of reciprocation of the nozzle as it moves from one end of the path to the other, and to pivot the nozzle about a vertical axis at each of the opposite ends of the path of reciprocation, whereby the plane of the spray is shifted about the vertical axis so as to be at an angle in the opposite direction relative to the path of reciprocation as the nozzle moves back toward the first end of the path. While such pivotal displacement of the nozzle may preclude a vertical buildup of plastic foam along the edges of a sprayed layer, the shifting of the nozzle about a vertical axis at the opposite ends of the path of reciprocation results in a herring bone-like pattern along the opposite edges. In certain applications, such as the applying of foamed plastic on a roof deck, several laterally adjacent runs are required in which the adjacent edges of the applied foam overlap, and such a herring bone-like pattern would not enable obtaining a smooth transition between the adjacent passes. While Edwards suggests his spray nozzle could be pivotal about a horizontal axis, such mounting in accordance with his disclosure would provide for the plane of the spray to be inclined in one direction relative to vertical during reciprocation of the nozzle to one end of the path thereof and then reversed in connection with reversal of the direction of movement of the nozzle toward the first end of the path. The reversal of the incline of the nozzle necessarily moves the outlet end thereof closer to the substrate than it was during the approach to the end of the path, and this would either provide for an overlay of the material at the turning point and/or gouging of the material beneath the nozzle as the material would not have had time to set or cure. Again, in connection with certain applications of foamed plastic material to a substrate, such as the laying of adjacent passes of foamed plastic on a roof deck, such overlaying or gouging would preclude obtaining the desired smooth transition between the adjacent passes.

SUMMARY OF THE INVENTION

In accordance with the present invention, plastic foam material applying apparatus of the foregoing character is provided with a dispenser or nozzle mounting arrangement by which the nozzle discharge is in a vertical plane during reciprocation of the nozzle transverse to the direction of relative movement between the apparatus and substrate and is deflected laterally outwardly at each of the opposite ends of the path of reciprocation by pivoting the dispenser about a horizontal axis parallel to the direction of relative movement between the apparatus and substrate. When the direction of reciprocation of the nozzle reverses at each of the opposite ends of the path of movement thereof, the nozzle returns to and remains in the vertical disposition during movement thereof toward the opposite end of the path. This advantageously provides for the layer of foamed plastic dispensed onto the substrate to be of uniform thickness between the opposite side edges thereof and to be feathered outwardly relative to the side edges such that the feathered portions between adjacent passes provide an area of transition between the adjacent passes which is smooth and of uniform thickness corresponding to that of the areas of the passes between the opposite sides thereof. Accordingly, in connection with the laying of a pass of foamed plastic material, vertical buildup along the opposite edges is advantageously avoided as is the overlaying, gouging and/or non-uniform pattern of the material along the opposite edges thereof.

In accordance with a preferred embodiment of the invention, the apparatus comprises a wheeled frame moveable along a roof deck, and the dispenser or spray nozzle is mounted on a carriage which is reciprocable along a linear carriage path transverse to the direction of movement of the frame along the roof deck. The dispenser is mounted on the carriage for displacement therewith along the carriage path and for pivotal displacement relative to the carriage about a horizontal axis transverse to the carriage path and at direction reversing locations at opposite ends of the carriage path. The dispenser is pivoted about the horizontal axis to each end of the carriage path to deflect the vertical plane of the spray nozzle laterally outwardly of the apparatus with respect to the direction of movement of the apparatus on the roof deck. When the direction of movement of the carriage is reversed, the dispenser is pivoted back to its neutral position in which the plane of the spray discharge is vertical. Further in accordance with the preferred embodiment, the carriage support and the dispenser mounting arrangement on the carriage include interengaging cam track and follower components providing for the pivoting of the dispenser at the opposite ends of the carriage path and the return of the dispenser to its neutral position upon reversal of the direction of movement of the carriage.

It is accordingly an outstanding object of the present invention to provide improved apparatus for applying foamed plastic materials to an underlying substrate and of the character wherein a dispenser on the apparatus and the substrate are relatively displaceable in a given direction and the dispenser is supported on the apparatus for reciprocating movement in opposite directions along a path transverse to the given direction.

Another object is the provision of improved apparatus of the foregoing character in which the dispenser is pivotal laterally outwardly at each of the opposite ends of the path to provide a feathering of the foamed material along the opposite edges of a pass thereof.

A further object is the provision of improved apparatus of the foregoing character which is operable in connection with the laying of a pass of foamed plastic to feather the opposite edges of the pass laterally outwardly thereof so as to avoid a vertical buildup and/or an undesirable contouring or surface profile along the edges.

Yet a further object is the provision of improved apparatus of the foregoing character which provides for feathering the laterally opposite edges of adjacent passes of the foamed material to provide a smooth transition area between the adjacent passes.

Yet another object is the provision of improved apparatus of the foregoing character in which the dispenser has a discharge axis in a plane which is vertical during displacement of the dispenser in opposite directions along the path of movement thereof and wherein the dispenser is pivoted about a horizontal axis to deflect the plane laterally outwardly at each of the opposite ends of the path.

Yet another object is the provision of improved apparatus of the foregoing character comprising a wheeled frame displaceable in a given direction along an underlying substrate and on which the dispenser is supported for displacement therewith in the given direction and for displacement relative thereto along a path transverse to the given direction and in which the dispenser is pivotally displaceable about a horizontal axis at each of the opposite ends of the path of reciprocation thereof to provide a feathering of the opposite edges of a pass of material dispensed onto the substrate during movement of the frame in the given direction and reciprocation of the dispenser in opposite directions along the path transverse to the given direction.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 8 is a plan view in section of a portion of the dispenser support and drive assembly housing showing a shock absorbing arrangement for the carriage;

DESCRIPTION OF A PREFERRED EMBODIMENT

Figure 1:
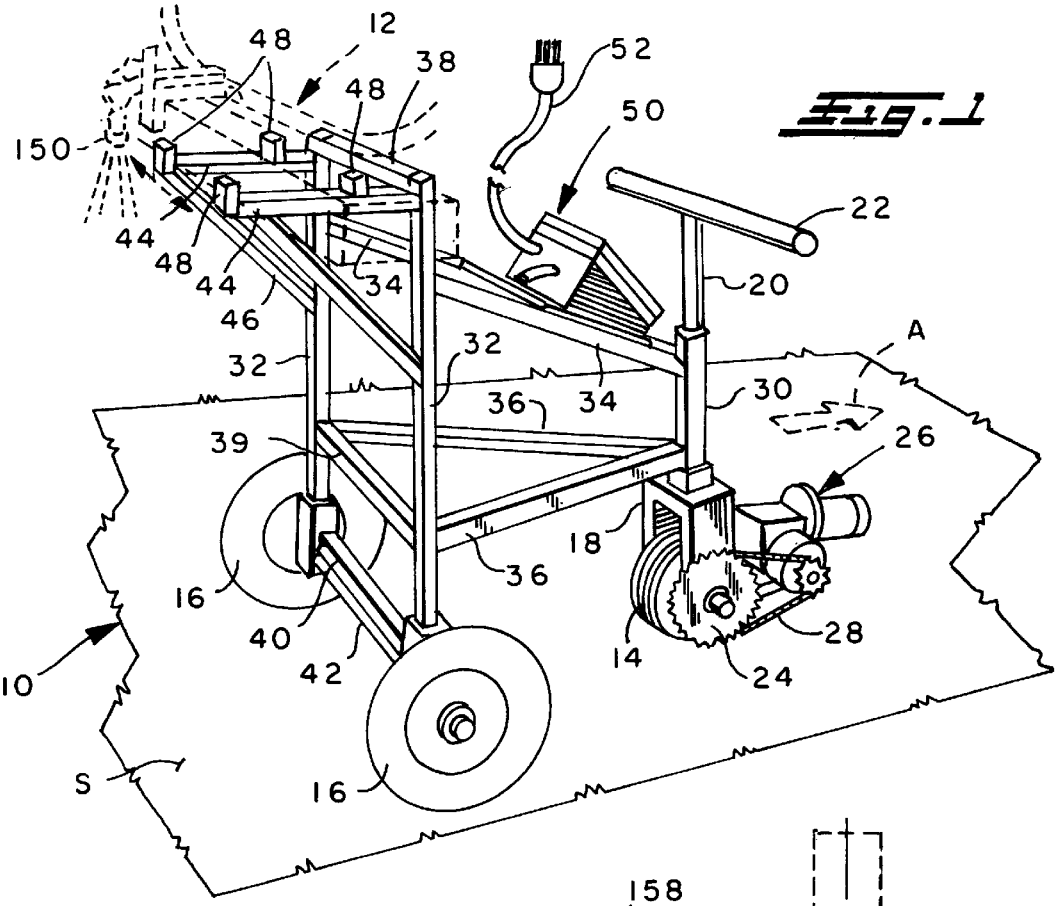
FIG. 1 is a perspective view of the wheeled frame of apparatus in accordance with the invention and showing the dispenser support and drive assembly thereon in phantom.

Referring now in greater detail to the drawings wherein the showings are for the purpose of illustrating a preferred embodiment of the invention only and not for the purpose of limiting the invention, apparatus for applying foamed plastic material on a roof substrate is illustrated in FIGS. 1–10 and comprises a wheeled frame 10 moveable in a given direction along a roof deck substrate S, and a dispenser support and drive assembly 12 to be described in greater detail hereinafter. In the embodiment illustrated, frame 14 is generally triangular in plan view and comprises a front wheel 14 and a pair of rear wheels 16 which support the frame for movement along roof substrate S. Front wheel 14 is pivotally mounted on the frame by a yoke 18 and a steering post 20 having a crossbar 22 at the upper end thereof by which an operator can pivot wheel 14 and thus control the direction of movement of the frame. Wheel 14 is provided with a drive sprocket 24 which is adapted to be driven by an electric motor and gear reduction unit 26 through a sprocket chain 28. Steering post 20 extends upwardly through a support collar 30, and the rear end of the frame includes a pair of upright frame members 32 adjacent wheels 16 and interconnected with collar 30 by upper side frame members 34 and lower side frame members 36. Rear frame members 32 are laterally spaced apart and interconnected by upper, intermediate and lower cross members 38, 39 and 40, respectively, and wheels 16 are mounted on the lower ends of frame members 32 by an axle 42. Cradle arms 44 extend rearwardly from rear frame members 32 and are vertically reinforced relative thereto by corresponding angular brace members 46, and longitudinally spaced apart cradle fingers 48 extend upwardly from the outer and inner ends of cradle arms 44.

Figure 6:
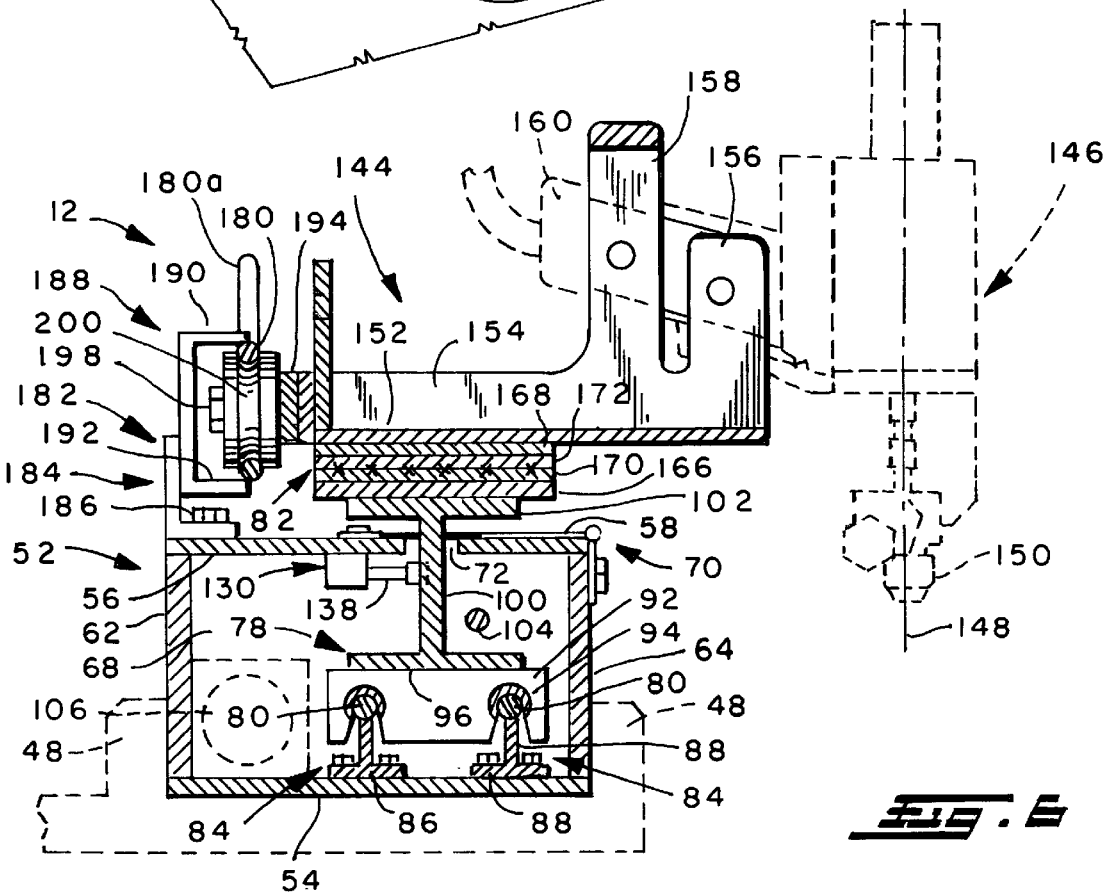
FIG. 6 is an enlarged cross-sectional elevation view of the carriage and dispenser support components taken along line 6—6 in FIG. 2.
Figure 10:
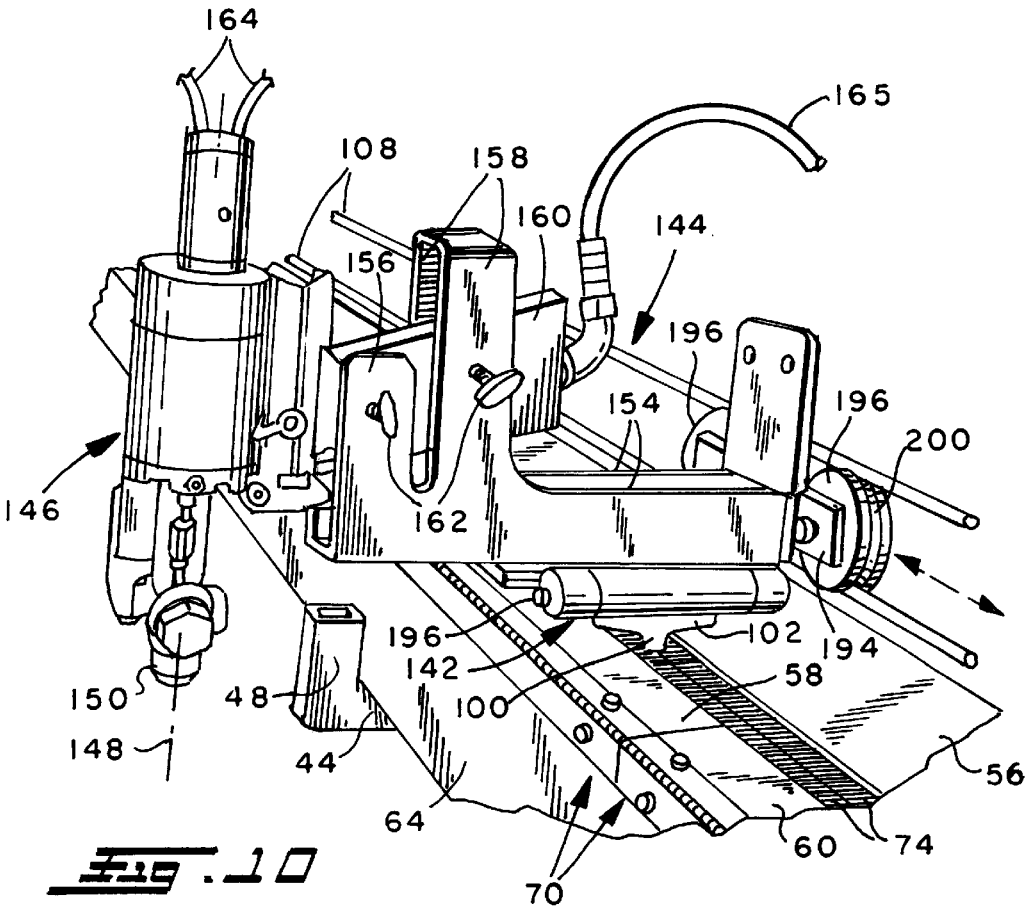

The component parts of frame 10 are suitably interconnected such as by welding and, as will be appreciated from FIGS. 1, 6 and 10 of the drawing, dispenser support and drive assembly 12 rests on cradle arms 44 between fingers 48 so as to be longitudinally stabilized relative to frame 10. Support and drive assembly 12 can be laterally stabilized relative to frame 10 such as by a pair of bolts, no shown, mounted on front wall of the housing of the support and drive assembly and receiving one of the fingers 48 therebetween. Frame 10 also supports a control box 50 adapted to be connected to a suitable source of electrical power by a cord 52 and which control box is interconnected with the motor of motor and gear reduction unit 26 and with electrical components of the dispensing gun and the drive motor therefor in dispenser support and drive assembly 12 such that an operator of the apparatus can control the displacement thereof along substrate S and the operation of the foamed plastic dispenser in connection with the application of foamed plastic to substrate S. As will become apparent hereinafter, in operating the apparatus to apply foamed plastic to substrate S, frame 10 is driven forwardly with respect to the direction between the front and rear wheels thereof, as indicated by arrow A, along a path determined by the angular position of wheel 14 relative to rear wheels 16, and the foamed plastic is dispensed downwardly from the rear end of dispenser support and drive assembly 12 as the latter moves forwardly with frame 10.

Figure 2:
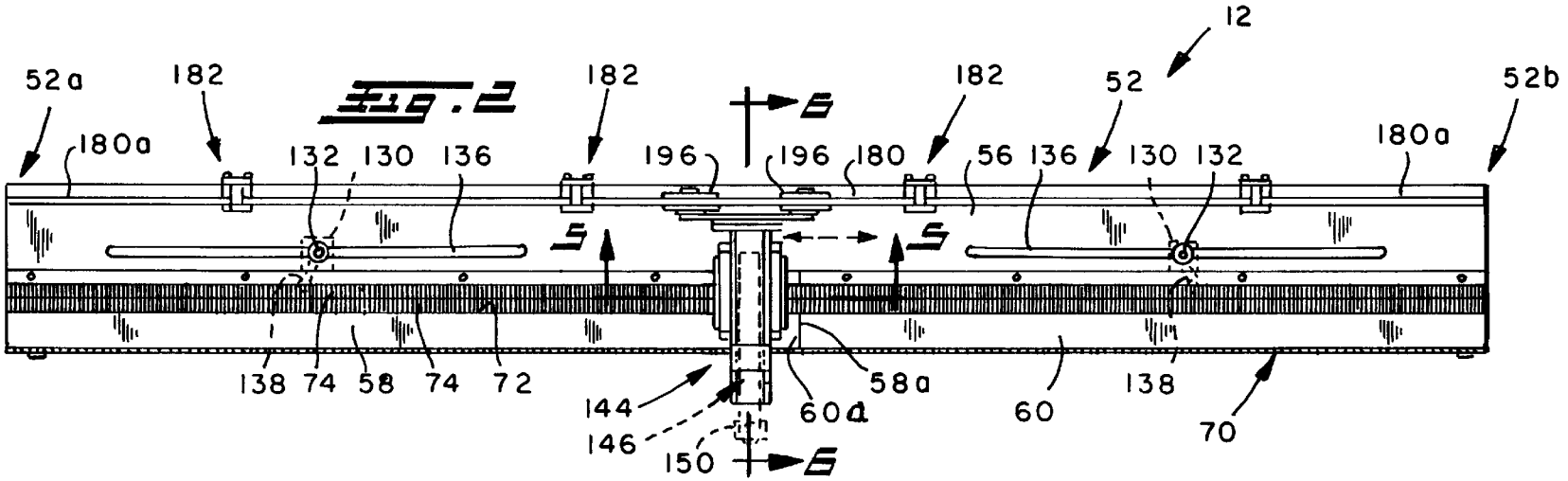
FIG. 2 is a plan view of the dispenser support and drive assembly.

Referring now in particular to FIGS. 2–10 of the drawing, dispenser support and drive assembly 12 comprises an elongate housing 52 which, when mounted on frame 10 extends transverse to direction of movement A thereof and has opposite ends 52*a* and 52*b*. Further, housing 52 includes a bottom wall 54, a top wall comprising top wall members 56, 58 and 60 and, with respect to the direction of forward movement A of frame 10, front and rear walls 62 and 64, respectively, extending vertically between the top and bottom walls. Each of the bottom, top and side walls extend between opposite ends 52*a* and 52*b* of the housing, and the latter is closed at the opposite ends by end walls 66 and 68. For the purpose set forth hereinafter, housing 52 further includes a partition wall 70 spaced inwardly adjacent end wall 66 and extending between the bottom, top and side walls of the housing. As shown in FIG. 2, top wall members 58 and 60 have adjacent inner edges 58*a* and 60*a*, respectively, and as seen in FIGS. 2 and 6, top wall members 58 and 60 are each pivotally mounted on rear wall 64 by a corresponding piano hinge 70 whereby each of the top wall members 58 and 60 is pivotal upwardly and outwardly to provide access to the interior of the housing. When top wall members 58 and 60 are closed with respect to the housing, as shown in FIG. 6 in connection with cover member 58, the inner edges of members 58 and 60 and the opposed inner edge of top wall member 56 are spaced apart to provide a slot or opening 72 extending between the opposite ends of the housing for the purpose which will become apparent hereinafter and, preferably, the opposed inner edges of the wall members are provided with corresponding brush strips 74 which protect against the ingress of dirt and other foreign matter into the interior of the housing. The housing walls can be constructed, for example, from ¼" aluminum sheet material and are suitably interconnected such as by the use of threaded fasteners not shown. Although other fastening arrangements can be used, it is preferred to removably mount top wall panel 56 on the front and end walls of the housing so as to facilitate access to the entirety of the inside of the housing.

As best seen in FIGS. 4–7, dispenser supporting and drive assembly 12 further includes a carriage 78 which is supported for reciprocation in opposite directions between ends 52*a* and 52*b* of the housing along a linear carriage path defined in part by linear carriage track members 80, and a dispenser mounting plate assembly 82 which is mounted on carriage 78 for movement therewith along the carriage path and for pivotal displacement relative thereto in the manner and for the purpose set forth more fully hereinafter. Carriage track members 80 are circular steel rods extending between partition wall 70 and end wall 68 of the housing and mounted on bottom wall 54 of the housing by a corresponding plurality of inverted T-shaped supports 84 spaced apart between the partition and end wall and having flanges 86 secured to bottom wall 54 by threaded fasteners, not designated numerically and webs 88 extending upwardly from flanges 86 and having rods 80 attached to the upper ends thereof such as by pins, not shown. Carriage 78 includes a base member 92 having track openings therethrough lined with corresponding bearing sleeves 94 which receive rods 80 and support the carriage for sliding movement therealong. Carriage 78 further includes an upper member in the form of an I-beam having a lower flange 96 secured to base member 92 by threaded fasteners, not shown, a web 100 extending upwardly through opening 72 in the top wall of the housing, and an upper flange 102 to which dispenser mounting plate assembly 82 is secured as set forth more fully hereinafter.

Carriage 78 is adapted to be driven in opposite directions along the linear carriage path defined by rails 80 by a threaded drive shaft 104 extending between the opposite ends of the housing and a carriage drive motor 106 mounted on bottom wall 54 and/or rear wall 62 such as by threaded fasteners, not shown. Carriage drive shaft 104 has its opposite ends rotatably supported by shaft bearings 108 and 110 which are respectively on housing end wall 68 and partition wall 70, and drive shaft 104 extends through bearing 110 and an opening in partition wall 70 and has a terminal end in the space between end wall 66 and partition wall 70 which is provided with a drive pulley 112. Carriage drive motor 106 which, in the preferred embodiment, is a reversible electric motor, has power input through line 107 from control panel 50, and has an output shaft 114. Shaft 114 is rotatably supported on partition wall 70 by a shaft bearing 116 and extends through bearing 116 and a hole in partition wall 70 and has a terminal end in the space between end wall 66 and partition wall 70 which is provided with a drive pulley 118. Pulleys 112 and 118 are drivingly interconnected by an endless belt 120, whereby rotation of output shaft 114 in opposite directions about its axis rotates carriage drive shaft 104 in corresponding directions about its axis. Carriage drive shaft 104 is drivingly interconnected with carriage 78 by an internally threaded drive coupling 122 which includes an internally threaded sleeve portion 124 threadedly interengaged with drive shaft 104, and a radially outwardly extending peripheral flange 126 by which the coupling is mounted on flange 96 and web 100 of the upper carriage member by means of threaded fasteners 128. Accordingly, it will be appreciated that rotation of drive shaft 104 in one direction about its axis displaces carriage 78 in one direction along the carriage path as defined by rails 80 and that rotation of drive shaft 104 in the opposite direction displaces the carriage in the opposite direction along the carriage path.

Reversal of the direction of rotation of carriage drive motor output shaft 114 is controlled by a pair of microswitches 130 which, as best seen in FIGS. 2 and 6 of the drawing, are mounted on the underside of top wall member 56 of the housing by means of nuts 132 threadedly interengaged with posts, not designated numerically, extending upwardly from the corresponding switch through an elongate slot 136 in the top wall member. Each of the microswitches has an actuator 138 in the path of movement of web 100 of the upper carriage member whereby, when carriage 78 reaches a direction reversing location along the carriage path defined by the position of microswitch 130 relative to the corresponding end of housing 52, the microswitch is actuated and is operable through circuitry including motor 106 and control panel 50 to reverse drive motor 106 and thus the direction of rotation of carriage drive shaft 104, whereupon the direction of displacement of the carriage is reversed. When the carriage reaches the opposite end of the carriage path, the other microswitch is actuated, whereby drive motor 106 is again reversed to reverse the direction of rotation of the carriage drive shaft and thus the direction of displacement of the carriage. Accordingly, it will be appreciated that when motor 106 is continuously energized, carriage 78 and dispenser mounting plate assembly 82 thereon is continuously reciprocated in the direction between the opposite ends of the housing of the dispenser support and drive unit and between the direction reversing locations relative to the carrier path as defined by the positions of microswitches 130 along the slots 136. While a reversely threaded carriage drive shaft could be used in connection with a non-reversing drive motor, such a drive shaft requires the carriage to reach each of the opposite ends of the shaft before the direction of displacement of the carriage is reversed. Accordingly, it will be appreciated that a drive shaft and reversible drive motor in accordance with the preferred embodiment advantageously provides for adjusting the length of the carriage path and thus the width of a layer of foamed plastic applied to the underlying substrate without having to change the dispenser support and drive assembly 12.

Figure 5:
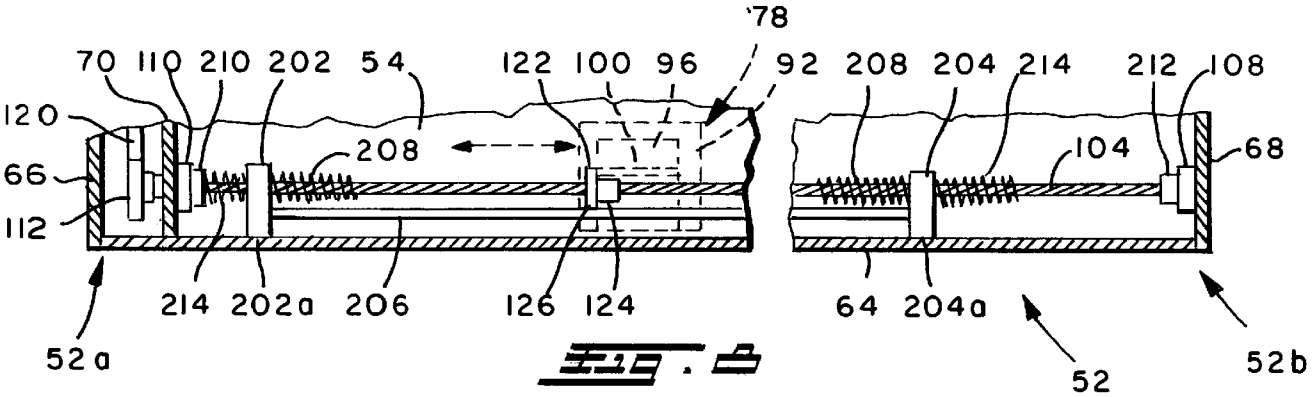
FIG. 5 is an enlarged sectional elevation view of the carriage and dispenser mounting components taken along line 5—5 in FIG. 2.
Figure 5:
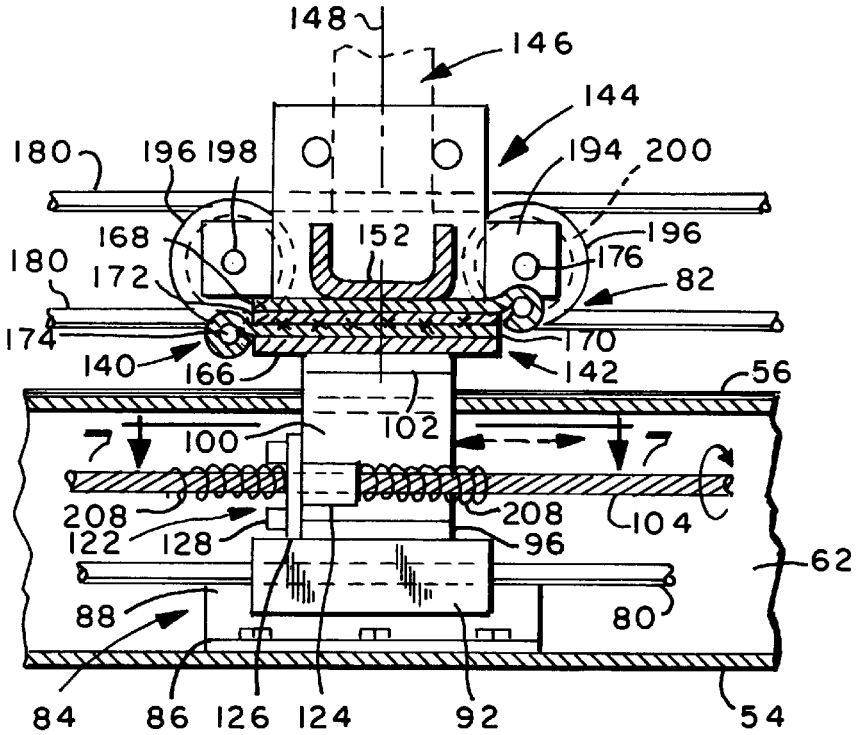

As best seen in FIGS. 2, 3, 5, 6, and 10, dispenser mounting plate assembly 82 comprises a pair of spring loaded hinges 140 and 142 between the flange 102 of the upper carriage member and a dispenser mounting bracket 144 which removably supports a foamed plastic dispenser 146 in the form of a dispensing gun having a dispensing axis 148 which, in the neutral position of hinges 140 and 142 shown in FIG. 5 is vertical and transverse to the carriage path. In the embodiment illustrated, dispenser 146 is a hand-held spray gun such as that available from Gusmer Corporation of Lakewood, N.J. under the latter's product designation Model GX7. Such a spray gun has an outlet nozzle 150 for discharging expandable plastic foam material downwardly toward substrate S in a spray pattern which, when dispensing axis 148 is vertical, is in a vertical plane transverse to the direction of the carriage path. In the present embodiment, the dispensing gun is supported outwardly adjacent rear wall 64 of housing 52, and mounting bracket 144 includes a bottom wall 152 attached to mounting plate assembly 82 as set forth hereinafter, side walls 154 which are spaced apart in the direction of the carriage path and extend upwardly from bottom wall 152, and pairs of dispenser mounting plates 156 and 158 extending upwardly from the side walls at the rear or outer ends thereof. Dispenser 146 is a hand-held spray gun for manually applying foamed plastic to a substrate and, accordingly, includes a hand grip portion 160. In the present embodiment, dispenser 146 is removably mounted on mounting bracket 144 by positioning hand grip portion 160 between the pairs of plates 156 and 158 and by providing at least one of each of the pairs of mounting plates with thumb screws 162 for clamping the hand grip between the mounting plates. The dispensing gun is connected in a well-known manner by hoses 164 to suitable dispensing equipment by which component materials of the foamed plastic are heated and delivered to the dispenser for mixing therein and dispensing therefrom through nozzle 150. An air line 169 is connected to the dispenser for purging the latter of the chemical components such as when the apparatus is to be shut down. Dispenser 146 is electrically operated, and operation thereof is controlled by the operator of the apparatus at control panel 50.

As will be appreciated from the description thus far, carriage drive motor 106 operates to rotate carriage drive shaft 104 so as to displace carriage 78 and thus the dispensing gun along the carriage path and between direction reversing locations along the path at which the direction of displacement of the carriage and thus the foam dispensing gun is reversed. Reciprocating displacement of the dispensing gun in opposite directions is continuous whereby, in connection with displacement of frame 10 along an underlying substrate, foamable plastic material is progressively applied to the substrate behind the moving frame and along a path having a width determined by direction reversing locations on the dispenser support and drive assembly.

In accordance with the present invention, the dispenser is adapted to be pivoted at each of the direction reversing locations about a horizontal axis transverse to the direction of the carriage path so as to pivot the dispensing axis 148 laterally outwardly of the corresponding end of the carriage path in conjunction with reversing the direction of movement of the carriage and dispenser at the corresponding end of the carriage path. Such pivotal displacement feathers the corresponding side edge of the pass of foamed material laterally outwardly of the edge defined by the point at which the discharge of material is deflected from the vertical plane. In the preferred embodiment, the pivoting of dispenser 146 to achieve such deflection of the spray discharge is achieved by mounting plate assembly 82 in conjunction with a cam and follower arrangement between the mounting plate assembly and housing 52 of dispenser support and drive assembly 12. More particularly in this respect, as will be best appreciated from FIG. 5, lower leaf 166 of hinge 140 and upper leaf 168 of hinge 142 are respectively attached to flange 102 of the upper carriage member and bottom wall 152 of the dispenser mounting bracket, such as by threaded fasteners which are not shown, and upper leaf 170 of hinge 140 and lower leaf 172 of hinge 142 are interconnected with one another such as by welding. Accordingly, it will be appreciated that mounting bracket 144 and thus dispenser 146 are pivotal with hinge 142 and upper leaf 170 of hinge 140 counterclockwise about the horizontal axis provided by pintle 174 of hinge 140, and that mounting bracket 144 and thus dispenser 146 are pivotal clockwise with upper leaf 168 of hinge 142 about the horizontal axis defined by pintle 176 of hinge 142. As mentioned hereinabove, hinges 140 and 142 are spring loaded to the positions shown in FIG. 5, whereby the foregoing pivotal displacement about pintles 174 and 176 is against the bias of the loading springs which, as is well known, are inside the pintle housings and, accordingly, are not visible. It will be further appreciated that while a pair of hinges provide the mounting plate arrangement in the disclosed embodiment, a plate corresponding to the intermediate plate defined by hinge leaves 170 and 172 could be pivotally attached to one end of the upper carriage member and a second plate corresponding to hinge leaf 168 could be pivotally attached to the first plate at the opposite end of the upper carriage member to provide the desired pivotal support for the dispenser mounting bracket and dispenser.

As best seen in FIGS. 3, 5, 6, and 9, the cam and follower arrangement referred to above includes a pair of vertically spaced apart cam rails 180 extending between the opposite ends of housing 52 and mounted on top of wall member 56 adjacent front wall 52 by mounting brackets 182 having L-shaped lower portions 184 suitably secured to top wall member 56 such as by threaded fasteners 186, and channel shaped upper portions 188 having a web portion 190 secured to a lower portion such as by welding and vertically spaced apart flanges 192 extending inwardly from web 190 and to the opposed inner sides of which rails 180 are secured such as by welding. The inner or front end of dispenser mounting bracket 144 includes a roller mounting plate 194 extending in the direction of the carriage path and having a pair of cam follower rollers 196 rotatably mounted on the opposite ends thereof such as by bolts 198. Each of the cam follower rollers includes a peripheral groove 200 having a radially inner diameter corresponding to the vertical distance between cam rails 180, whereby the follower rollers are received between the rails for rolling movement therealong. The opposite ends of cam rails 180 are curved upwardly relative to top wall member 56 of the housing to provide curved track portions 180a at each of the opposite ends of the housing in areas corresponding to the direction reversing locations as defined by the positions of limit switches 130.

Figure 3:
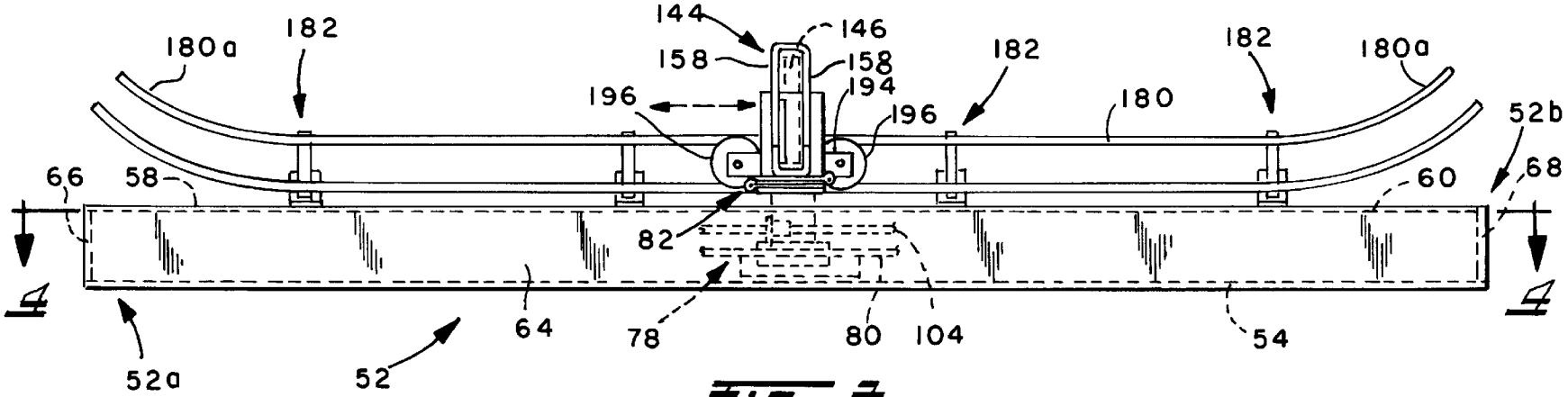
FIG. 3 is a front elevation view of the dispenser support and drive assembly.
Figure 4:
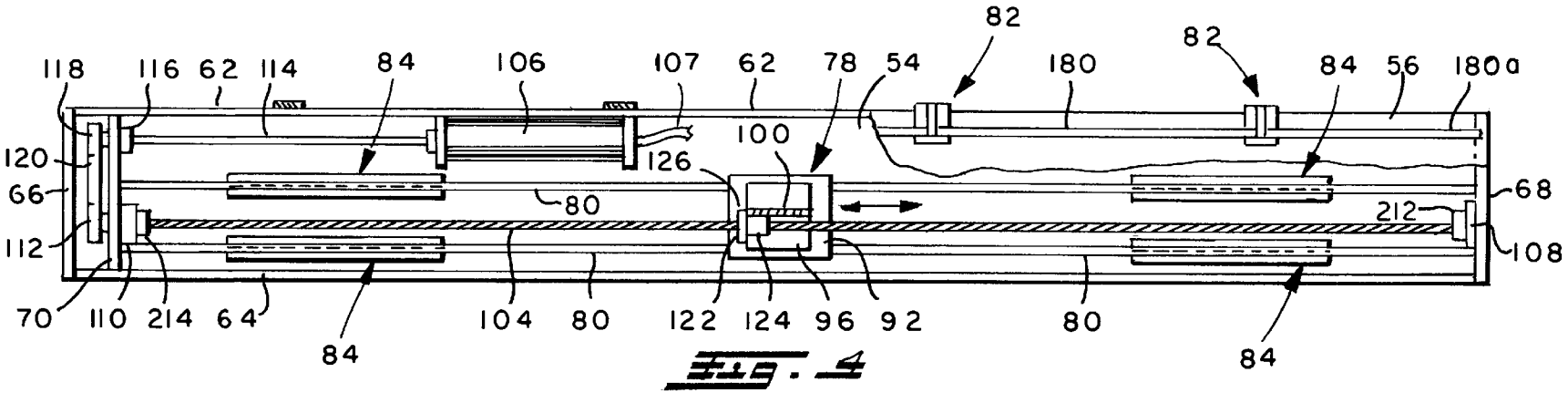
FIG. 4 is a plan view of the dispenser support and drive assembly housing with the top wall removed and looking in the direction of line 4—4 in FIG. 3.
Figure 9:
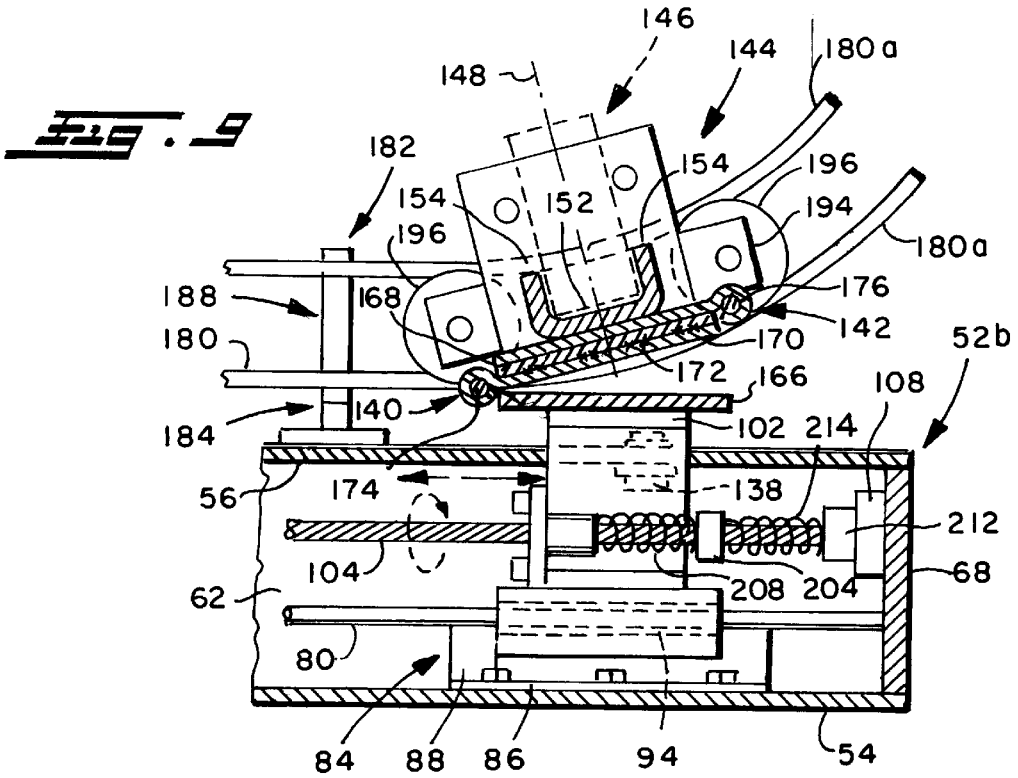
FIG. 9 is an enlarged sectional elevation view of the carriage and dispenser mounting components similar to FIG. 5 and showing the dispenser mounting components in the pivoted disposition thereof at the direction reversing location at one end of the carriage path; and, FIG. 10 is a perspective view of the dispenser mounting components showing a dispenser in the form of a dispensing gun mounted thereon.

As will be appreciated from FIGS. 3, 5 and 9, and assuming carriage 78 and thus dispenser 146 to be moving to the right in FIG. 3, toward end 52*b* of housing 52, when carriage 78 reaches the direction reversing location, microswitch actuator 138 engages web 100 of the upper carriage member to effect reversal of the carriage drive motor and thus carriage drive shaft 104. Contemporaneously therewith, and during the deceleration, stopping and reacceleration of carriage 78 in the opposite direction, follower rollers 196 and end portions 180*a* of the cam rails interengage as shown in FIG. 9 to pivot dispenser mounting bracket 144 counterclockwise about hinge pintle 174, whereby axis 148 of the dispenser is pivoted for the foamed plastic material to be sprayed laterally outwardly of end 52*b*. It will be appreciated that the deceleration, stopping and reacceleration of carriage 78 in the opposite direction is a continuous motion whereby, upon reacceleration and movement of carriage 78 to the left in FIG. 9, the follower rollers and cam tracks interengage to pivot dispenser mounting bracket 144 and thus dispenser 146 clockwise about hinge pintle 174 back to the neutral position shown in FIG. 5. The mounting bracket and dispenser are maintained in the latter position during movement of carriage 78 along the linear carriage path to the direction reversing location at end 52*a* of housing 52. As will be appreciated from the foregoing description, when carriage 78 reaches the direction reversing location at end 52*a* of the housing, microswitch 130 at the latter end of the housing operates through its actuator 138 to effect reversal of the carriage drive motor and drive shaft and, in connection with the deceleration, stopping and reacceleration of carriage 78 at end 52*a* of the housing, follower rollers 196 engage ends 180*a* of the cam tracks at end 52*a* to pivot dispenser mounting bracket 144 and thus dispenser 146 clockwise about hinge pintle 176 so as to pivot dispenser axis 148 and thus the spray of foamed plastic material laterally outwardly of end 52*a* of housing 52. In addition to interengaging to achieve pivotal displacement of the dispenser mounting bracket and dispenser at the opposite ends of the linear carriage path, cam rails 180 and cam follower rollers 196 interengage to laterally and vertically stabilize dispenser mounting bracket 144 and dispenser 146 during reciprocating displacement of carriage 78, optimize the smoothness of the movement of the carriage, dispenser mounting bracket and dispenser during operation of the apparatus to optimize the quality and surface uniformity of the material applied to the substrate and to minimize the imposition of forces through the carriage to the carriage drive shaft and support rails, thus to minimize wear and/or other damage thereof.

The spraying of foamed plastic material onto an underlying substrate in the foregoing manner is continuous so long as carriage drive motor 106 is energized and dispenser 146 is operated to dispense foamed plastic material from the nozzle thereof, both of which operations are controlled by the operator at control panel 50 on frame 10. Further, it will be appreciated that the operator, through control panel 50, can energize and control the speed of motor and gear reduction unit 26 by which the frame is moved along the substrate, or can deenergize the motor and gear reduction unit and manually pull the apparatus along the substrate and, in either event, control the direction of movement of frame 10 through steering post 20 and crossbar 22.

Figure 7:
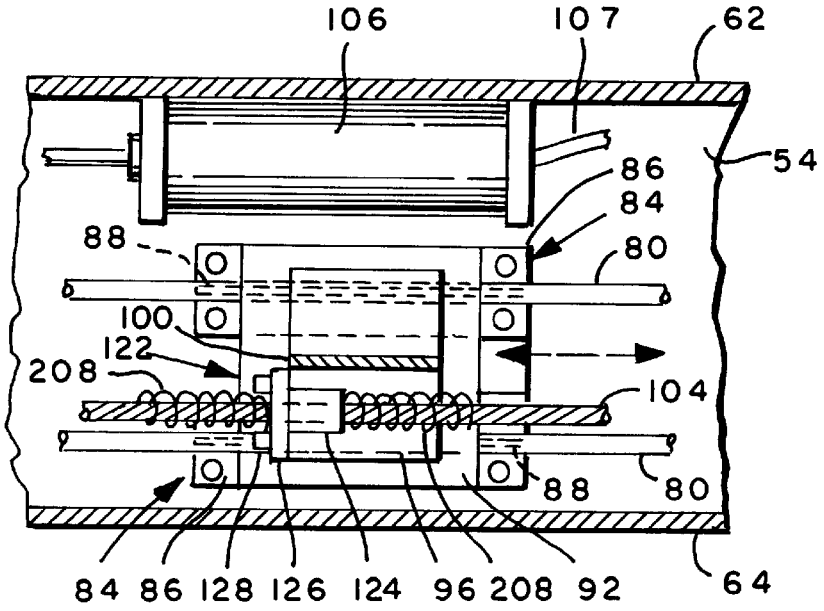
FIG. 7 is a plan view in section of the carriage taken along line 7—7 in FIG. 5.

Preferably, as shown in part in FIGS. 5, 7 and 9, and in its entirety in FIG. 8, a floating shock absorbing arrangement is provided to cushion the deceleration and stopping of the carriage which takes place as explained hereinabove at each of the opposite ends of the carriage path. The shock absorbing arrangement comprises a pair of abutment blocks 202 and 204 slidably received on carriage drive shaft 104 on axially opposite sides of carriage 78 and rigidly interconnected in spaced apart relationship by a connecting rod 206 therebetween. Abutment blocks 202 and 204 have outer edges 202*a* and 204*a*, respectively, which slidably engage the inner surface of rear wall 64 of housing 52 and have bottom edges, not shown which slidably engage carriage rail 80 therebeneath, whereby the abutment blocks are stabilized against rotation relative to drive shaft 104. The shock absorbing arrangement further includes a first pair of compression springs 208 slidably received on carriage drive shaft 104 respectively between abutment block 202 and flange 126 of drive coupling 122 and between abutment block 204 and sleeve 124 of the drive coupling. The axially opposite ends of carriage drive shaft 104 are provided with abutment blocks 210 and 212 mounted thereon for rotation therewith, and the shock absorbing arrangement includes a second pair of compression springs 214 slidably received on drive shaft 104 between abutment blocks 202 and 210 and between abutment blocks 204 and 212.

As will be appreciated from FIG. 8 and the description hereinabove with regard to the deceleration, stopping and reacceleration movement of slide 78 at the direction reversing locations along the slide path, and assuming slide 78 in FIG. 8 to be moving to the right from the position shown, the slide will initially move relative to abutment blocks 202 and 204 until sleeve 124 of drive coupling 122 engages the corresponding end of compression spring 208. At that time, abutment blocks 202 and 204 and compression springs 208 move to the right with carriage 78 toward end 52*b* of the housing. During the deceleration, stopping and reacceleration of slide 78 at the direction reversing location adjacent end 52*b* of the housing, compression spring 214 engages abutment block 212, and deceleration and stopping of the carriage is cushioned by the compression of spring 214 between abutment blocks 204 and 212 and by the compression of spring 208 between sleeve 124 and abutment block 204. The reacceleration of the slide to the left in FIG. 8 is made smooth by the progressive decompression of springs 208 and 214, and it will be appreciated that the shock absorbing arrangement works in the same manner when carriage 78 reaches the direction reversing location adjacent end 52*a* of the housing.

While considerable emphasis has been placed herein on the structures and structural interrelationships between the component parts of the preferred embodiment, it will be appreciated that other embodiments of the invention can be made and that many changes can be made in the preferred embodiment without departing from the principles of the invention. In this respect, it will be appreciated that the carriage can be reciprocated other than by a rotary drive shaft and that the cam and follower arrangement for pivoting the foamed plastic dispenser at the opposite ends of the carriage path can be other than the cam rails and follower rollers disclosed herein. In this respect, for example, the hinge pintles could be extended axially forwardly of the dispenser mounting bracket so as to be received in a cam slot which would interengage with the pintle to pivot the corresponding hinge plate to achieve the desired pivoting of the dispenser. Further, while it is preferred in connection with the preferred embodiment to use a pair of vertically spaced cam rails to optimize stability of the dispenser mounting bracket, the bottom rail is the only rail necessary to achieve pivoting of the dispenser at the opposite ends of the carriage path. Still further, while it is preferred for the latter purpose to have the cam rails continuous between the opposite ends of the housing, it will be appreciated that the interengaging portions of the cam rails and follower rollers for achieving the desired pivoting of the dispenser need only be in the direction reversing areas adjacent the opposite ends of the housing. Still further, the internally threaded drive coupling on the carriage for the carriage drive shaft could be integral with the carriage as opposed to being attached thereto. Moreover, arrangements other than the hinged arrangement can be provided between the carriage and dispenser or dispenser mounting brackets to achieve pivotal displacement of the dispenser about a horizontal access transverse to the linear carriage path at opposite ends of the latter. The foregoing and other modifications as well as other embodiments of the inventions will be suggested to those skilled in the art from the disclosure herein, whereby it is to be distinctly understood that the foregoing descriptive matter is to be interpreted merely as illustrative of the invention and not as a limitation.

Having thus described the invention, it is so claimed:

1. In apparatus for applying foamed plastic material on a substrate comprising an expandable plastic foam material dispenser having a dispensing axis, a frame, means for relatively displacing said frame and said substrate in a given direction, dispenser support means supporting said dispenser on said frame for reciprocation relative thereto in laterally opposite directions with respect to said given direction and for said dispensing axis to be oriented for directing expandable plastic foam material downwardly onto said substrate, and means for reciprocating said dispenser in said laterally opposite directions and between direction reversing locations in said opposite directions, the improvement comprising: said dispenser support means comprising a carriage supporting said dispenser and carriage support means supporting said carriage for displacement in said laterally opposite directions along a linear carriage path, and means interengaging at each of said direction reversing locations for pivoting said dispenser relative to said carriage about a horizontal axis parallel to said given direction for shifting said dispensing axis laterally outwardly of said carriage at the corresponding direction reversing location.

2. Apparatus according to claim 1, wherein said frame includes means for engaging an underlying substrate and supporting said frame for movement in said given directions thereon.

3. Apparatus according to claim 2, wherein said means for engaging an underlying substrate includes a plurality of wheels.

4. Apparatus according to claim 3, wherein said means for relatively displacing said frame and said substrate includes means for driving at least one of said wheels.

5. Apparatus according to claim 1, wherein said dispenser support means comprises vertically spaced apart top and bottom walls and horizontally spaced apart side walls between said top and bottom walls, said top, bottom and side walls extending in said laterally opposite directions and having laterally opposite ends, and an end wall at each of said opposite ends.

6. Apparatus according to claim 1, wherein said carriage support means comprises linear, parallel carriage tracks supporting said carriage for sliding displacement therealong, and said means for reciprocating said dispenser includes a carriage drive motor and means drivingly connecting said carriage drive motor and said carriage.

7. Apparatus according to claim 6, wherein said carriage drive motor has an output shaft and said means drivingly connecting said carriage drive motor and said carriage includes a threaded carriage drive shaft, a threaded drive coupling on said carriage interengaging with said carriage drive shaft to displace said carriage along said carriage drive shaft in response to rotation thereof, and means drivingly interconnecting said output shaft and said carriage drive shaft for said carriage drive motor to rotate said carriage drive shaft.

8. Apparatus according to claim 7, wherein said carriage drive motor is reversible, and means engaged by said carriage at each of said direction reversing locations for reversing said carriage drive motor.

9. Apparatus according to claim 7, wherein said output shaft and said carriage drive shaft are parallel and laterally spaced apart, and said means drivingly interconnecting the output and carriage drive shafts includes an endless drive belt therebetween.

10. Apparatus according to claim 1, wherein said carriage includes dispenser mounting means mounting said dispenser thereon for movement therewith in said laterally opposite directions and for said pivotal displacement of said dispenser relative thereto at each of said direction reversing locations.

11. Apparatus according to claim 10, wherein said means interengaging at each of said direction reversing locations includes cam means on one of said dispenser support means and said dispenser mounting means and cam follower means on the other of said dispenser support means and dispenser mounting means.

12. Apparatus according to claim 11, wherein said cam means is on said dispenser support means and said cam follower means in on said dispenser mounting means.

13. Apparatus according to claim 12, wherein said cam means includes at least one cam rail curving upwardly relative to said linear carriage path at each of said direction reversing locations and said cam follower means includes at least one cam roller engaging said at least one cam rail.

14. Apparatus according to claim 13, wherein said cam means includes a pair of vertically spaced apart cam rails and said cam follower means includes a pair of laterally spaced apart cam rollers each engaging between said pair of cam rails.

15. Apparatus according to claim 10, wherein said dispenser mounting means includes mounting plate means between said carriage and said dispenser and supporting said dispenser for pivotal displacement about first and second pivot axes laterally spaced apart and extending transverse to said carriage path, pivotal displacement about the first pivot axis being in one direction relative to said carriage and pivotal displacement about the second pivot axis being in the direction opposite said one direction.

16. Apparatus according to claim 15, wherein said mounting plate means includes a first mounting plate pivotal relative to said carriage about said first pivot axis, and a second mounting plate pivotal with said first mounting plate about said first pivot axis and pivotal relative to said first mounting plate and said carriage about said second pivot axis, said dispenser being attached to said second mounting plate.

17. Apparatus according to claim 16, wherein each said first and second mounting plate has a neutral position relative to said carriage, and means biasing each mounting plate to pivot about the corresponding pivot axis toward the neutral position.

18. Apparatus according to claim 1, and shock absorbing means interengaging with said carriage and said dispenser support in each said direction reversing location.

19. Apparatus according to claim 18, wherein said means for reciprocating said dispenser includes a threaded carriage drive shaft having opposite ends and a threaded drive coupling on said carriage interengaging with said drive shaft to displace said carriage therealong in response to rotation thereof, said carriage having opposite sides facing said opposite ends of said drive shaft, and said shock absorbing means being between said carriage sides and each of said opposite ends of said drive shaft.

20. Apparatus according to claim 19, wherein said shock absorbing means includes first abutment blocks slidable on said drive shaft, said first abutment blocks being spaced from said opposite sides of said carriage and interconnected for sliding displacement together relative to said drive shaft and carriage, a second abutment block on each of said opposite ends of said drive shaft, first floating springs on said drive shaft between said carriage and said first abutment blocks, and second floating springs on said drive shaft between said first and second abutment blocks.

21. Apparatus for applying foamed plastic material on a substrate comprising an expandable plastic foam material dispenser having a dispensing axis, a wheeled frame for displacement relative to said substrate along a path of movement, a dispenser support and drive assembly on said frame for movement therewith and extending transverse to said path of movement, said support and drive assembly having opposite ends and including a carriage, carriage track means supporting said carriage for sliding displacement in opposite directions along a linear carriage path between said ends, means for reciprocating said carriage in said opposite directions and between direction reversing locations adjacent said opposite ends, dispenser mounting means mounting said dispenser on said carriage for displacement therewith along said carriage path with said dispensing axis in a vertical plane transverse to said carriage path and for pivotal displacement of said dispenser relative to said carriage, and means adjacent each of said opposite ends of said support and drive assembly interengaging with said dispenser mounting means to pivot said dispenser about a horizontal pivot axis transverse to said carriage path for deflecting said vertical plane of said dispensing axis outwardly of the corresponding one of said opposite ends.

22. Apparatus according to claim 21, wherein said wheeled frame comprises a plurality of wheels and means for driving at least one of said wheels for displacing said wheeled frame relative to said substrate.

23. Apparatus according to claim 21, wherein said carriage track means includes a pair of linear, parallel track members extending between said opposite ends of said support and drive assembly and said means for reciprocating said carriage includes a threaded carriage drive shaft parallel to said track members, a threaded drive coupling on said carriage interengaging with said drive shaft to displace said carriage along said drive shaft in response to rotation of said drive shaft, and means to rotate said drive shaft.

24. Apparatus according to claim 23, wherein said means to rotate said drive shaft includes a reversible drive motor, means drivingly interconnecting said drive motor and drive shaft, and means engaged by said carriage at each of said direction reversing locations for reversing said drive motor.

25. Apparatus according to claim 24, wherein said carriage drive shaft has opposite ends and said carriage has opposite sides facing said ends of said drive shaft, and an impact absorbing assembly comprising first abatement blocks slidable on said drive shaft, said first abatement blocks being spaced from said opposite sides of said carriage and interconnected for sliding displacement together relative to said drive shaft and carriage, a second abatement block on each of said opposite ends of said drive shaft, first floating springs on said drive shaft between said carriage and said first abutment blocks, and second floating springs on said drive shaft between said first and second abutment blocks.

26. Apparatus according to claim 21, wherein said dispenser mounting means includes mounting plate means between said carriage and said dispenser and supporting said dispenser for pivotal displacement about first and second pivot axes laterally spaced apart and extending transverse to said carriage path, pivotal displacement about the first pivot axis being in one direction relative to said carriage and pivotal displacement about the second pivot axis being in the direction opposite said one direction, and said means interengaging with said dispenser mounting means including at least one cam rail on said support and drive assembly extending between said opposite ends thereof and having rail ends curving upwardly relative to said linear carriage path, and follower rollers on said dispenser mounting means engaging said cam rails ends for pivoting said dispenser about said first pivot axis at one of said rail ends and about said second pivot axis at the other of said rail ends.

27. Apparatus according to claim 26, wherein said mounting plate means includes a first mounting plate pivotal relative to said carriage about said first pivot axis, and a second mounting plate pivotal with said first mounting plate about said first pivot axis and pivotal relative to said first mounting plate and said carriage about said second pivot axis, said dispenser being attached to said second mounting plate, said means interengaging with said dispenser mounting means including a pair of vertically spaced apart cam rails receiving said follower rollers therebetween.

28. Apparatus according to claim 21, wherein said dispenser support and drive assembly comprises a housing having vertically spaced apart top and bottom walls and horizontally spaced apart side walls between said top and bottom walls, said top, bottom and side walls extending between said opposite ends of said support and drive assembly, and an end wall at each of said opposite ends.

29. Apparatus according to claim 28, wherein said housing includes a partition wall spaced inwardly of one of said end walls, said carriage track means including a pair of linear parallel track members mounted on said bottom wall and extending between said partition wall and the other of said end walls of the housing, said means for reciprocating said carriage including a threaded carriage drive shaft rotatably supported on said partition wall and said other end wall, a threaded drive coupling on said carriage interengaging with said drive shaft to displace said carriage along said drive shaft in response to rotation of said drive shaft, and a carriage drive motor in said housing for rotating said drive shaft.

30. Apparatus according to claim 29, wherein said drive motor has an output shaft parallel to said carriage drive shaft and rotatably supported on said partition wall, each said output shaft and said drive shaft having a terminal end in the space between said one end wall and said partition wall, and drive belt means interconnecting said terminal ends for said drive motor to rotate said carriage drive shaft.

31. Apparatus according to claim 30, wherein said carriage drive motor is a reversible electric motor, and a microswitch on said top wall of said housing at each of said direction reversing locations for engagement by said carriage to reverse said drive motor, the location of each said microswitch being adjustable in the direction between said end walls of said housing.

32. Apparatus according to claim 28, wherein said carriage track means is on said bottom wall of said housing and said carriage has an upper end extending through an opening therefor in said top wall and which opening extends in the direction between said end walls, said upper end being above said top wall, said dispenser mounting means including mounting plate means between said upper end of said carriage and said dispenser and supporting said dispenser on said carriage for pivotal displacement about first and second pivot axes laterally spaced apart and extending transverse to said carriage path, pivotal displacement about the first pivot axis being in one direction relative to said carriage and pivotal displacement about the second pivot axis being in the direction opposite said one direction.

33. Apparatus according to claim 32, wherein said mounting plate means includes a first mounting plate pivotal relative to said upper end of said carriage about said first pivot axis, and a second mounting plate pivotal with said first pivot axis and pivotal relative to said first mounting plate and said upper end of said carriage about said second pivot axis, said dispenser being attached to said second mounting plate, said means interengaging with said dispenser mounting means including a pair of vertically spaced apart cam rails on said top wall of said support and drive assembly extending between said opposite ends thereof and having rail ends curving upwardly relative to said linear carriage path, and a pair of follower rollers on said dispenser mounting means engaging between said cam rails and interengaging with said rail ends for pivoting said dispenser about said first pivot axis at one of said opposite ends of said support and drive assembly and about said second pivot axis at the other of said opposite ends of said support and drive assembly.

34. Apparatus according to claim 33, wherein said drive motor has an output shaft parallel to said carriage drive shaft and rotatably supported on said partition wall, each said output shaft and said drive shaft having a terminal end in the space between said one end wall and said partition wall, and drive belt means interconnecting said terminal ends for said drive motor to rotate said carriage drive shaft.

35. Apparatus according to claim 34, wherein said carriage drive motor is a reversible electric motor, and a microswitch on said top wall of said housing at each of said direction reversing locations for engagement by said carriage to reverse said drive motor, the location of each said microswitch being adjustable in the direction between said end walls of said housing.

36. Apparatus according to claim 35, wherein said carriage has opposite sides, one facing said partition wall and the other facing the other of said end walls and said carriage drive shaft has an end portion at each said partition wall and other end wall, and a shock absorbing assembly comprising first abutment blocks slidable on said drive shaft, said first abutment blocks being spaced from said opposite sides of said carriage and interconnected for sliding displacement together relative to said drive shaft and carriage, said first abutment blocks slidably engaging said front wall of said housing, a second abutment block on each end portion of said drive shaft, first floating springs on said drive shaft between said carriage and said first abutment blocks, and second floating springs on said drive shaft between said first and second abutment blocks.

37. Apparatus according to claim 36, wherein said wheeled frame comprises a plurality of wheels and means for driving at least one of said wheels for displacing said wheeled frame relative to said substrate.

* * * * *